US009027304B2

(12) United States Patent
McClure

(10) Patent No.: US 9,027,304 B2
(45) Date of Patent: May 12, 2015

(54) WALL INSULATION SYSTEM WITH RECTANGULAR BLOCKS

(75) Inventor: Richard R. McClure, Basehor, KS (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 14/009,284

(22) PCT Filed: Mar. 9, 2012

(86) PCT No.: PCT/US2012/028592

§ 371 (c)(1),
(2), (4) Date: Dec. 20, 2013

(87) PCT Pub. No.: WO2012/134773

PCT Pub. Date: Oct. 4, 2012

(65) Prior Publication Data

US 2014/0102026 A1 Apr. 17, 2014

Related U.S. Application Data

(60) Provisional application No. 61/470,947, filed on Apr. 1, 2011.

(51) Int. Cl.
*E04B 1/74* (2006.01)
*E04B 2/56* (2006.01)
(Continued)

(52) U.S. Cl.
CPC ..... *E04B 2/562* (2013.01); *E04F 13/0823* (2013.01); *E04F 13/12* (2013.01); *E04H 5/10* (2013.01); *E04B 1/62* (2013.01)

(58) Field of Classification Search
CPC ..... E04D 13/1618; E04D 3/3602; E04D 13/1625; E04D 13/1643; E04D 2003/3615; E04D 3/366; E04B 1/762; E04B 1/7662; E04B 1/7666; E04B 2/58; E04B 9/363; E04B 1/7616; E04B 1/24; E04B 1/62; E04F 13/12
USPC ..... 52/407.2, 407.3, 407.4, 512, 404.1, 52/478, 483.1, 742.1, 742.12, 404.2, 52/404.3, 309.16
See application file for complete search history.

(56) References Cited

U.S. PATENT DOCUMENTS 791,980 A * 6/1905 Fisher ..... 52/506.08
1,150,594 A * 8/1915 Hale ..... 52/506.09
(Continued)

FOREIGN PATENT DOCUMENTS

EP 1333131 A1 8/2003
GB 2198464 A 6/1988
GB 2337060 A 11/1999

OTHER PUBLICATIONS

PCT application PCT/US2012/028592 International Search Report and Written Opinion dated Jul. 3, 2012, 12 pages.

*Primary Examiner* — Joshua J Michener
*Assistant Examiner* — Matthew Gitlin
(74) *Attorney, Agent, or Firm* — Lathrop & Gage LLP

(57) ABSTRACT

A wall system (110) is disclosed which is mounted onto girts (114) on a building. Rectangular foam blocks (126) are installed between the outer flange of the girts, and the inside surfaces of the wall panel (112). Some vertically spaced apart blocks are located behind the wall seams, and other blocks are located intermediate the seams. The spacing created by the blocks allows for a blanket of insulation (118) between the blocks and the support members to be expanded, improving the system's insulative properties.

8 Claims, 3 Drawing Sheets

(51) Int. Cl.

| | |
|---|---|
| ***E04F 13/08*** | (2006.01) |
| ***E04F 13/12*** | (2006.01) |
| ***E04H 5/10*** | (2006.01) |
| ***E04B 1/62*** | (2006.01) |

(56) References Cited

U.S. PATENT DOCUMENTS

| | | | | | |
|---|---|---|---|---|---|
| 3,452,500 | A | * | 7/1969 | Heirich | 52/478 |
| 3,521,419 | A | * | 7/1970 | Fornells | 52/506.09 |
| 3,861,326 | A | * | 1/1975 | Brown | 108/57.29 |
| 3,885,370 | A | * | 5/1975 | Hirvensalo | 52/434 |
| 3,903,671 | A | | 9/1975 | Cuin et al. | |
| 3,998,016 | A | * | 12/1976 | Ting | 52/323 |
| 4,346,543 | A | * | 8/1982 | Wilson et al. | 52/404.2 |
| 4,375,741 | A | * | 3/1983 | Paliwoda | 52/127.1 |
| 4,566,239 | A | * | 1/1986 | Smigel et al. | 52/407.4 |
| 4,571,909 | A | * | 2/1986 | Berghuis et al. | 52/309.8 |
| 4,651,489 | A | * | 3/1987 | Hodges et al. | 52/409 |
| 5,020,293 | A | * | 6/1991 | Itagaki | 52/314 |
| 5,085,023 | A | * | 2/1992 | Duffy | 52/410 |
| 5,181,360 | A | * | 1/1993 | Shingler | 52/520 |
| 5,561,959 | A | * | 10/1996 | Alderman et al. | 52/407.3 |
| 8,615,946 | B2 | * | 12/2013 | Oberg | 52/404.1 |
| 8,739,486 | B2 | * | 6/2014 | Bodsford et al. | 52/506.05 |
| 2005/0011154 | A1 | * | 1/2005 | Kim | 52/506.06 |
| 2012/0159885 | A1 | * | 6/2012 | Oberg | 52/404.3 |

* cited by examiner

WALL INSULATION SYSTEM WITH RECTANGULAR BLOCKS

CROSS-REFERENCE TO RELATED APPLICATIONS

This application claims the benefit of U.S. Provisional Application No. 61/470,947 filed Apr. 1, 2011, the entire contents of which are herein incorporated by reference.

BACKGROUND OF THE INVENTION

1. Field of the Invention

The invention relates generally to the field of constructing buildings. More specifically, the invention relates to the field of insulating metal buildings.

2. Description of the Related Art

Conventionally, metal buildings are constructed according to a series of steps. First, a metal frame is constructed. The metal frame includes numerous structural support members. The roof portions include sloped roof structural members referred to as purlins. The walls include vertically spaced horizontally extending members, which are referred to as girts. Once the frame is installed, it is common to insulate both the roof and wall portions of the building.

With respect to roof arrangements, blanket insulation is draped over the tops of the purlins, and then roof panels are fastened over the insulation. In some cases, it has been known to install a longitudinal thermal block above the top flange of the purlin such that it runs the entire length of the purlin over the draped blanket insulation.

With respect to the conventional wall, blanket insulation is secured from above such that it is draped over horizontally extending girts. Then metal wall panels are fastened to the outer flanges of the girts, compressing the blanket insulation between the wall panel and the outer flange of each girt where they interface. These lines of packed-down insulation create heat losses.

SUMMARY

The disclosed embodiments include a wall system comprising spaced apart insulative blocks in between a wall panel and the outside flanges of the girts on the building. The blocks not only move the wall panel a distance from the outside flanges of the gifts equal to block thickness, but also enable the expansion of blanket insulation into the space created between the blocks. Some of the blocks are installed at a seam between two wall panels, and a second group of blocks is installed at a location intermediate the seam and another seam.

A method is also disclosed. The method involves providing a building structure having a plurality of vertically displaced horizontal support members; obtaining a wall panel having at least one inwardly-extending feature on an inside surface of the wall; installing a plurality of foam insulation blocks between an outside surface of the horizontal support members and the inside surfaces of the wall panel; and fastening the wall to the horizontal support members through the blocks sandwiching the blocks. Some of blocks are vertically spaced-apart behind the building seams, and another group of blocks is vertically spaced-apart behind an inwardly extending portion of the wall panel which is in between the seams.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Embodiments of the present invention provide an insulated metal panel system for a building, and a method for constructing a metal panel for the wall of a building.

Figure 1A:
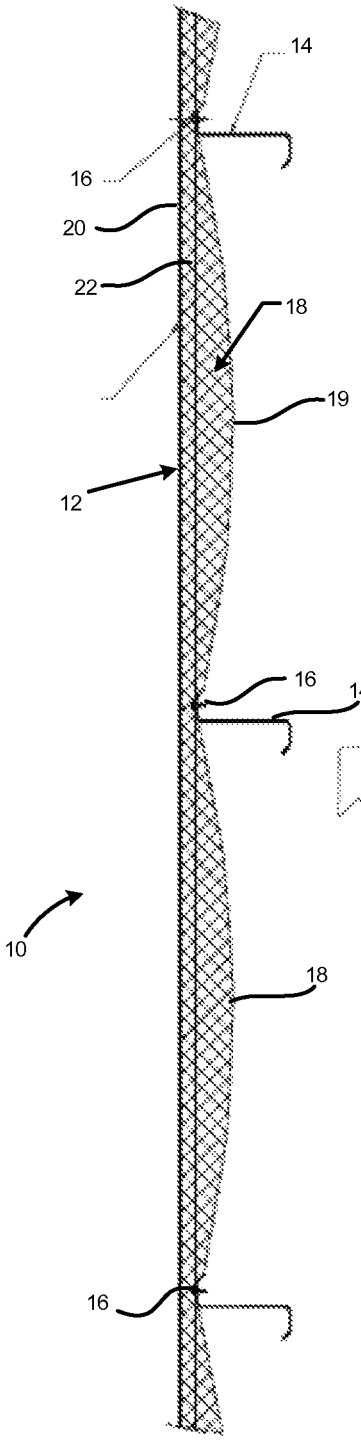
FIG. 1A Prior Art
FIG. 1A shows a cross-sectional wall section of a conventional insulated wall panel.
Figure 1B:
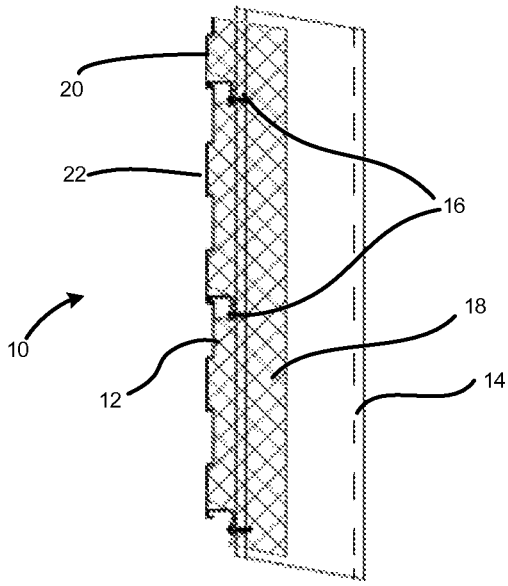
FIG. 1B Prior Art
FIG. 1B shows a top view of a horizontal section taken from a conventional insulated metal building wall design.
Figure 1C:
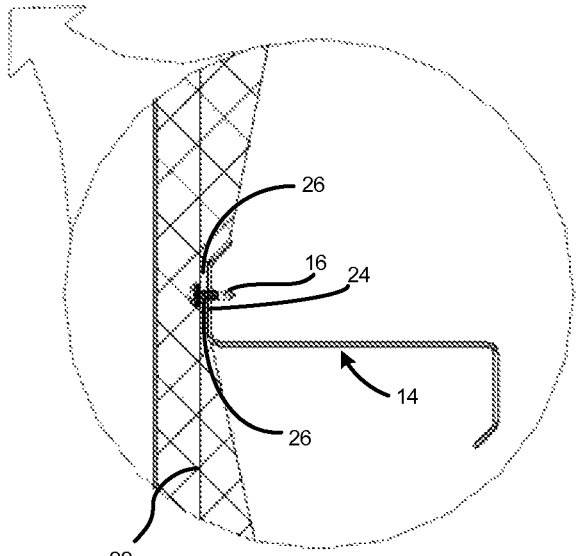
FIG. 1C Prior Art
FIG. 1C is a broken out section showing the specifics around a girt for the conventional design shown in FIGS. 1A and 1B.

In order to provide a context for the disclosed embodiments, prior art drawings FIG. 1A, FIG. 1B, and FIG. 1C show that which is known in the prior art. Referring first to FIG. 1A, a conventional system 10 is shown in which a plurality of metal wall panels 12 are installed to create a building wall. These sorts of wall panels 12 are normally fastened to a plurality of horizontally running and vertically spaced Z-girts 14. The type of paneling disclosed in FIGS. 1A-C is referred to by the tradename STYLWALL® and is manufactured by BlueScope Butler located in Kansas City, Mo., a business group of BlueScope Steel Limited, Australia. The STYLWALL® panel system uses a series of vertically extending panels which are interlocked. The version shown in FIGS. 1A-C is fluted (see, e.g., the plurality of flutes 113 in FIG. 2). An extending lateral flange on one side of each panel is fastened to the horizontal Z-girt using fasteners 16, which are typically self-tapping screws. Then, the other side of the panel is snapped into the preceding already-installed vertical panel, at the same time covering the already installed fasteners.

When insulation is desired, a blanket of insulation 18 having a facing 19 on the inside is typically unrolled, and then draped down the outsides of the Z-girts 14 before the panels 12 are installed. The insulation 18 is held in place when the wall panels 12 are fastened and snapped into place on top of it.

FIG. 1A shows in more detail how the fasteners 16 are screwed into the outer flange 24 of the girt. The facing 19 prevents undesirable contact with inhabitants, presents a more appealing look, and creates a vapor barrier. When installed, the insulation 18 is pinched between the laterally-extending flange 22 that is used to receive the fasteners 16, and a locking mechanism. When the fasteners 16 are driven in, the insulation blanket 18 is crushed. This is shown even more clearly in the exploded view of FIG. 1C wherein the compacted insulation 26 can be seen in the area of fastener 16 between the underside of the laterally-extending flange 22 and the outermost surfaces of the girt 14.

The compacting of insulation 18 in area 26 causes significant heat losses. As those skilled in the art will recognize, the mashing down of blanket 18 creates an area where the thermal resistance is weakened. Because of this, if one were to look at heat flow diagrams in the areas near the outer flange 24 of the girt 14, they would see significant flow of heat energy through the area surrounding the fastener 16; this is primarily because the girt 14, the compacted insulation 18 at the point of attachment, and the portions of the lateral flange 22 all are relatively good heat conductors, creating an undesirable thermal passageway.

The insulation 18 (e.g., half way between the girts 14 in FIG. 1A) billows and fluffs outward the further it is from the connection points made with the girt outer flange 24. Considering that the insulation blanket is pinned between the inside surface of the channel 22 and the girt outer flange 24 at numerous panel locations, the heat loss because of the necessary compacting caused by the fasteners 16 is significant.

Figure 2:
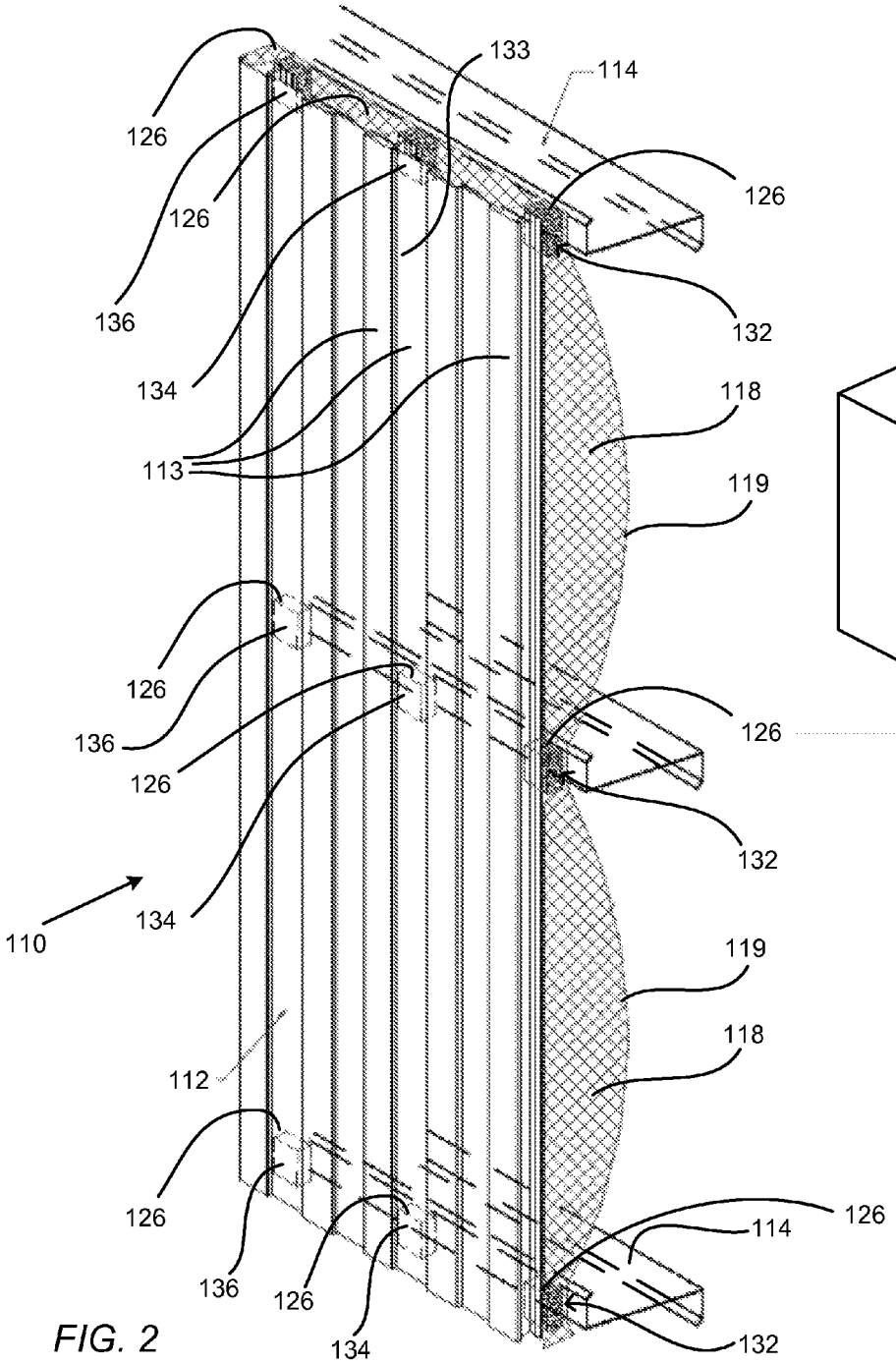
FIG. 2 shows a perspective view of an insulated wall according to the invention disclosed herein.
Figure 3:
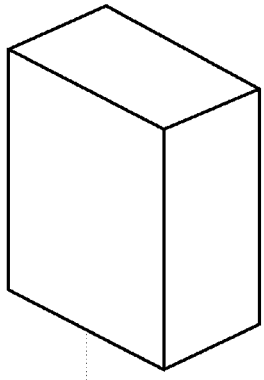
FIG. 3 shows a rectangular thermal block from perspective.

The arrangement of the present invention 110, which can be seen in FIGS. 2 through 4, greatly reduces the heat losses in the metal wall 112. As with the conventional system, the metal wall 112 is attached outside of the girts 114 of the building using fasteners 116. Also like with the conventional systems, a blanket of faced insulation 118 is draped down, and installed between the wall and the girt 114 when the wall is mounted. Also like with the conventional systems, the insulation blanket 118 has a facing 119 on the inside of the insulation 118.

But the new system 110 is different in that the panel 112 is not directly fastened to the outermost flange of the girt 124. Instead, a plurality of substantially rectangular foam spacer blocks 126 are intermittently fastened between the wall 112 and girt outer flange 124 along the length of the girt 114. Some of the blocks 126 are installed underneath seams (see, e.g., series 132 and 136) and others are located at intermediate panel locations (see, e.g., series 134) inside an inwardly extending corrugation 133.

Figures 4A, 4B, 4C, 4D:
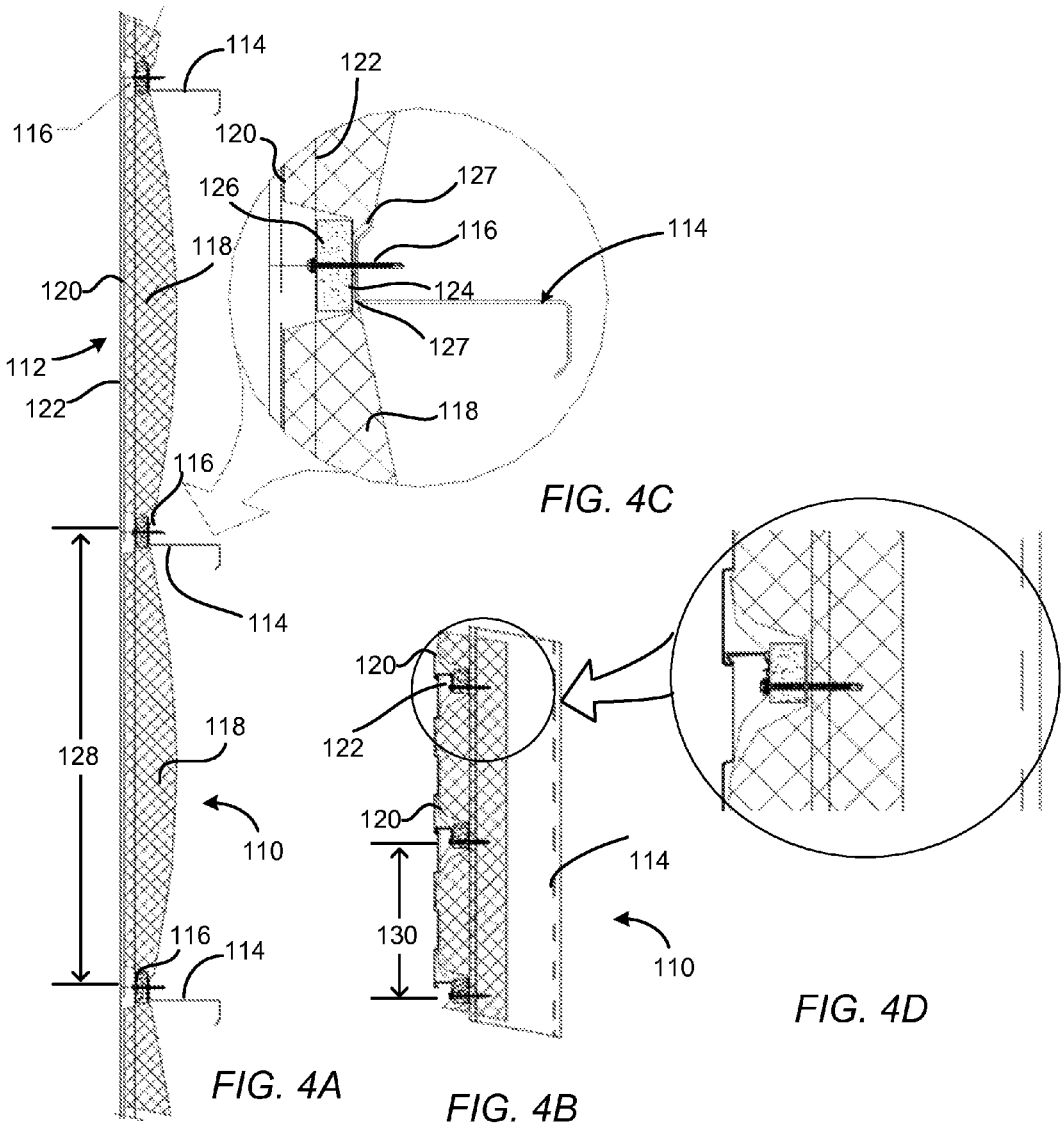
FIG. 4A shows a vertical section taken from the insulated wall of the present invention.
FIG. 4B shows a horizontal section taken from the insulated wall of the present invention.
FIG. 4C shows a broken out section taken from the vertical section of FIG. 4A.
FIG. 4D shows a broken out section taken from the horizontal section taken from FIG. 4B.

The spacer blocks 126 are spaced vertically by a distance 128 (see FIG. 4A) and laterally by a distance 130 (see FIG. 4B). This spacing 128, 130 not only maintains structural integrity, but also creates significant thermodynamic advantages. And the insulating material used to construct the spacer blocks 126 provides further thermal resistance, since each block is interposed between the metal wall panel 112 and the girt 114. Because the foam blocks 126 have sufficient structural integrity, they are not crushed, and effectively patch an insulative gap which normally exists at the locations of compacted blanket insulation 118 (in area 127) between the panel 120 and the girt outer flanges 124, both at seam locations 132, and at intermediate locations 134 (where the wall extends inward). As can be seen in FIG. 2, an array of spaced apart blocks is created.

In addition to providing thermal resistance, the blocks 126 also serve to space the wall apart from the girt outer flange 124 a distance equal to the thickness of the block 126. This creates more area for the blanket insulation 118 to billow out between the blocks 126, improving heat resistance.

The details regarding the spacer block 126 can best be seen in FIG. 3. From the figure, it can be seen that each spacer block is substantially rectangular—taller than they are wide when installed. But the blocks 126 could be differently shaped if needed, so long as they are able to fit between the girt 114 and panel 112 and space the two apart, and so long as the device provides the structural integrity needed.

The blocks 126 are sized and configured so that they fit between the inside ridge surfaces of the channel portions of the wall and the girt outer flange 124 at either the seams or at the intermediate locations.

In terms of assembly in the erection of the building, the girts 114 will already be in place as shown in the figures, and the remaining wall components will be installed outside them. In some embodiments, the blanket insulation 118 will be draped over the outsides of the girts 114. It is not necessary to independently fasten the insulation at this point, but in may instances it will make sense to secure the blanket 118 from above and allow it to drape down before fastening the wall 112 onto the girts 114. The next step, in embodiments, involves the securement of the blocks 126 in some way. In some embodiments, this means that the blocks 126 are adhered to the panel 112 in the locations shown prior to installation, so that when the panel 112 is raised to be installed, the fasteners 116 can be driven in. The precise position for adhering each block 126 will be determined by spacing the horizontal rows of blocks 126 at the vertical positions of each horizontally extending girt (see FIG. 2). This enables the user with all of the blocks 126 adhered, to place the panel 112 over the draped insulation 118 and hold the panel 112 in place.

Once the panel is held in the desired position, then, each fastener 116 (e.g., self-tapping screw) can be screwed through the panel 112 outside of where each block 126 exists, through the block 126, and bite into the girt outer flange 124. With respect to the blocks in the intermediate positions 134, it is only important that the fastener 116 be secured through a relatively central portion of the block to preserve structural integrity. At each seam, however, the screws 116 are positioned in an offset manner (see, e.g., FIG. 4D) relative to the block. This offset fastening will occur for each block in the series (e.g., blocks 132 and 136) located under a seam. This is because a desired fastener position is near the outermost edge of the seam flange. But please note that each block will be centered underneath the inwardly extending corrugation which will be at the seam.

Once all of the fasteners 116 have been installed, the panel/block assembly is secured to the building. The spacing provided by the block thickness allows for more fluffing of the insulation between the girts 114, and also allows for the fluffing into the spaces created between the blocks along the girt outer flange 114.

Fluffed blanket insulation is considerably more effective as a heat barrier than insulation that is matted down. Thus, a much higher percentage of the wall panel is backed by insulation which is billowed rather than matted down. Therefore, as opposed to the conventional system of FIG. 1, heat losses are greatly reduced by use of the blocks 126, 134. Also, in the FIGS. 2-4 embodiments where the insulation 118 has been crushed beneath the blocks 126, the insulating materials (foam) used to construct the blocks 126 provides an impediment to heat transfer. Thus, a high level of heat resistance is provided across the whole panel after it is installed, unlike the conventional systems.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A wall system comprising:

a plurality of vertically displaced horizontal support members;

a wall panel;

a plurality of insulation blocks spaced apart on the horizontal support members and oriented between an inside surface of the panel and the horizontal support members wherein the insulation blocks are installed in an evenly spaced apart relationship where one set of blocks is installed at a seam between two wall panels, and a second group of blocks is installed at a location intermediate the seam and another seam; and a blanket of insulation installed between the inside surface of the panel and the horizontal support members, portions of the blanket of insulation expanding into space created between the blocks.

2. The wall system of claim 1 wherein the blocks are substantially rectangular.

3. The wall system of claim 1 wherein:

the horizontal support members are girts; and fasteners connect the wall to an outside flange of the girts through at least one block.

4. The wall system of claim 1 wherein the blocks are vertically spaced from one another by a distance that is greater than a length of one individual block.

5. The wall system of claim 1 wherein the blocks are horizontally spaced from one another by a distance that is greater than a width of one individual block.

6. The wall system of claim 1 wherein the horizontal support members are girts, and the blocks are fastened into an outer flange of each girt.

7. The wall system of claim 1 wherein:

the thickness of each of the blocks results in a gap being created between the wall and the horizontal support members which enables the expansion of the blanket of insulation into a space created between all the blocks.

8. A method of making a wall comprising:

providing a building structure having a plurality of vertically displaced horizontal support members;

obtaining a wall panel having at least one inwardly-extending feature on an inside surface of the wall;

installing a plurality of foam insulation blocks between an outside surface of the horizontal support members and the inside surfaces of the wall panel; and locating a first group of the blocks at vertically spaced-apart positions along a seam between two panels;

locating a second group of blocks at vertically spaced-apart positions behind the inwardly extending feature of the wall panel; and fastening the wall to the horizontal support members through the blocks sandwiching the blocks there between.

* * * * *